US006077156A

United States Patent [19]

Amin et al.

[11] Patent Number: 6,077,156

[45] Date of Patent: Jun. 20, 2000

[54] GRINDING DISC

[75] Inventors: Rajul Amin, Northborough; Joseph Mielinski, Charlton; Glenn R. Knowlton, Sterling, all of Mass.

[73] Assignee: Norton Company, Worcester, Mass.

[21] Appl. No.: 09/212,713

[22] Filed: Dec. 16, 1998

[51] Int. Cl.[7] ..... B24B 7/00

[52] U.S. Cl. ..... 451/548; 125/15

[58] Field of Search ..... 451/6, 342, 359, 451/449, 490, 548; 125/15

[56] References Cited

U.S. PATENT DOCUMENTS

| | | | |
|---|---|---|---|
| Re. 25,434 | 8/1963 | Christensen | 451/548 |
| 4,021,969 | 5/1977 | Davis | 451/6 |
| 5,697,359 | 12/1997 | Okanishi et al. | 451/449 |

FOREIGN PATENT DOCUMENTS

| | | | |
|---|---|---|---|
| 1318689 | 1/1963 | France | 451/526 |
| 2207626 | 2/1989 | United Kingdom | 451/490 |
| WO 97/21521 | 6/1997 | WIPO . | |

*Primary Examiner*—M. Rachuba
*Attorney, Agent, or Firm*—David Bennett

[57] ABSTRACT

Abrasive discs with spaced portions removed from the circumference in the form of rounded and elongated V-shapes provide, when in use, complete vision of a workpiece being abraded with reduced tendency to snag on obstructions.

5 Claims, 1 Drawing Sheet

GRINDING DISC

BACKGROUND OF THE INVENTION

The present invention relates to grinding discs, particularly those intended for use with angle grinders. Typical grinding discs comprise a substrate or backing material upon which is deposited a maker coat which is used to adhere a coating of abrasive particles applied to the maker coat before it is cured. A size coat is conventionally applied over the abrasive particles to ensure that they are firmly anchored. A supersize coat may be applied over the size coat to confer added properties such as anti-loading, lubrication, grinding aids and the like. More recently other grinding surfaces have been provided in which the abrasive particles are dispersed within a binder which is then deposited on the substrate such that the abrasive material is made in a single step. This binder/abrasive layer may be deposited in a continuous layer that may be smooth or engineered to have a profiled surface with spaced abrading points. Alternatively it may be deposited in isolated islands leaving a profiled surface which also provides spaced abrading points. Such profiled surfaces are very suitable for fine finishing and polishing especially when the particle are small, such as below about 150 microns in average particle size.

The drawback of the traditional round abrading disc is that it is not possible to see the surface that is being ground such that it is necessary to grind and then remove to view the surface before grinding again and removing again to view the results. In addition the typical grinding process using conventional discs uses the disc with an attack angle to the workpiece surface of about 45 degrees. This results in gouging unless the operator is quite skilled. These problems were overcome in the invention described in PCT/US96/19191. The abrasive discs described in this Application comprise circular discs having portions removed from at least three spaced positions around the circumference of the disc and holes through the body of the disc, such that the combination of peripheral gaps and holes allow essentially complete view of the portion of the workpiece being ground as it is being ground. In addition to the increased vision and therefore control of the operation, the disc is designed to be used at a very much lower attack angle of about 15 degrees such that a much higher percentage of the actual disc surface is used. By contrast when operating at the traditional high angle of attack the disc has to be discarded after only the outer half inch or so of the periphery of the disc has been worn out. This translates to a much longer life for the disc along with cooler cutting.

The portions removed from the disc circumference according to the above specification are not restricted to straight chord segments but could include portions that leave the outer perimeter of the disc with a curved outline. The present invention relates to a particularly preferred outline that confers specific advantages especially when working on a surface that meets a second surface angled upward with respect to the surface being ground. In such situations it is possible for the edge of the disc to snag against the angled surface and perhaps tear the disc. The present invention represents a preferred solution to this situation that significantly reduces the consequences of a contact with such an angled surface.

GENERAL DESCRIPTION OF THE INVENTION

The present invention provides an abrasive disc having a generally circular configuration with a design direction of rotation when in use, said disc having from three to nine spaced portions removed from the circumference of the disc each such portion having leading and trailing edges defined with respect to the design direction of rotation of the disc, and a length defined by the circumferential distance between the points at which the leading and trailing edges meet the circumference, and wherein the deepest radial penetration of the removed portion into the disc occurs adjacent the leading edge of each removed portion.

For the sake of this invention the term "adjacent to" is intended to convey that the deepest radial penetration into the material of the disc of the portion removed from the periphery of the disc occurs within 20% and more preferably 10%, based on the total circumferential length of the removed portion, of the point at which the leading edge of the removed portion meets the circumference of the disc.

The removed portion can have a generally V-shaped outline, with one leg much longer than the other, but this is preferably modified by rounding the points at which the leading and trailing edges meet the circumference of the disc.

The most preferred profile for the portions removed from the periphery of the disc is one in which all angles of the removed portion are rounded such that the circumference of the disc presents from three to nine "parrot beak" profiles essentially as illustrated in the FIGURE attached hereto.

The elongation of the trailing edge has the effect of making the transition to the full circumference of the disc quite gradual such that there is no corner or angle to catch if the disc should approach and touch a surface set at an angle to the surface being ground. This effect is enhanced even more by rounding even the low angle at which the removed portion approaches the circumference. Even though the chances of snagging at the angle at which the leading edge of the removed portion meets the circumference are quite small, it is advantageous, as indicated above, to round off this angle also and this is a preferred feature of the invention.

The greatest radial depth of the removed portion, (which is intended to indicate the greatest amount of the disc, with respect to its radius, that is removed), preferably represents less than 20% of the radius of the unmodified disc. More preferably the greatest depth is from 5 to 15% of the disc radius.

The number of removed portions is from three to nine and is preferably from three to six. In general the larger the number, the shallower the preferred depth of penetration into the material of the disc represented by the removed portions. Three removed portions are generally most preferred.

DESCRIPTION OF THE PREFERRED EMBODIMENTS

Figure 1:
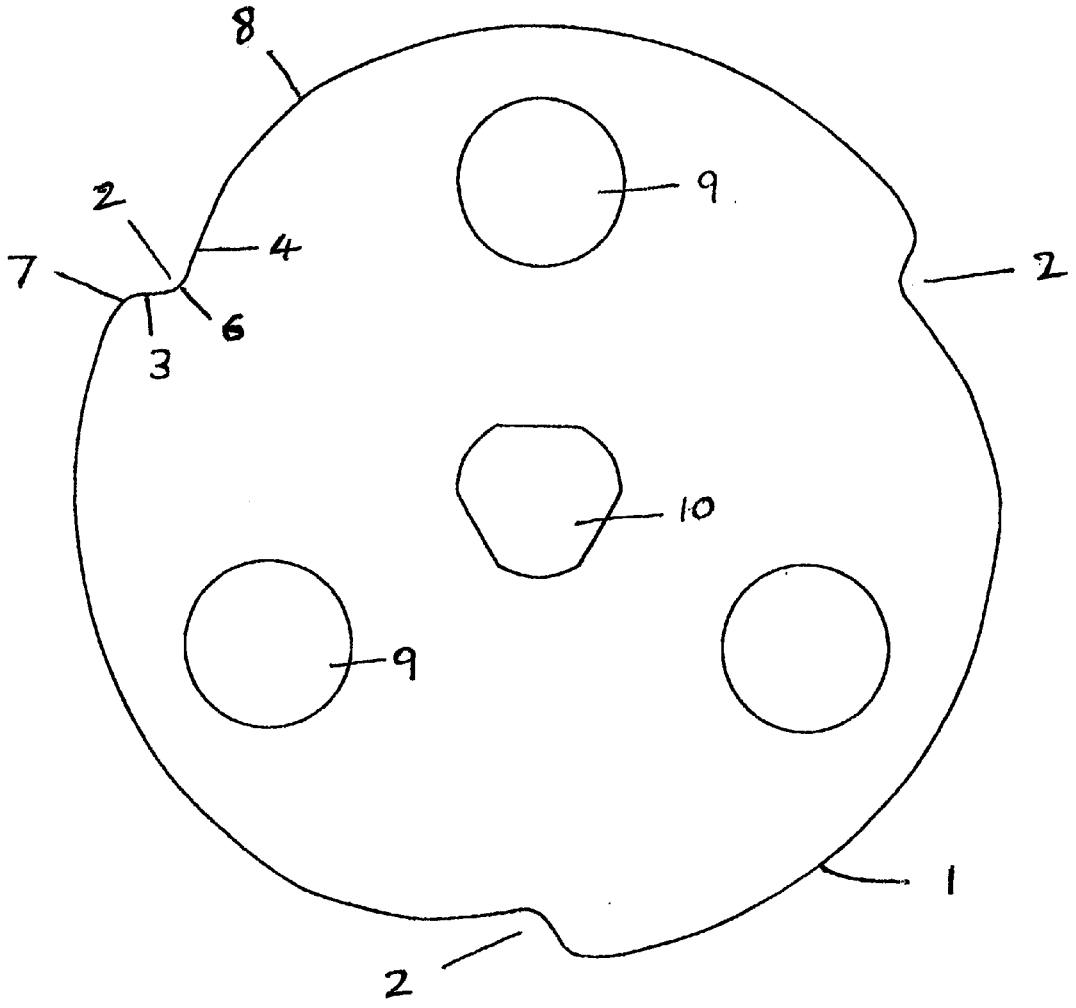

The abrasive surface of the disc can be a conventional surface made by successive applications of maker, abrasive particles, size and optionally supersize layers. However it can also have a profiled surface produced by molding, embossing or gravure printing an abrasive/binder composite deposited on a backing material.

The backing can be made from natural or artificial fibers woven, which have been formed into a coherent sheet material by any conventional process such as knitting, weaving or needle-punching a non-woven fiber assembly. It can also be a paper or film backing such as are commonly used in the industry.

The abrasive grain can be any of those conventionally used to make abrasive discs such as fused or sintered alumina, silicon carbide, fused alumina/zirconia and the like. The binder by which the particles are held can be a phenol/formaldehyde such as is commonly used for most abrasive discs or it could be one of the many other thermally curable substitutes that have been proposed such as urea/formaldehyde resins and epoxy resins. Radiation-curable resins such acrylate-based resins as well as epoxy-urethanes and epoxyacrylates can also be used.

In addition to the portions removed from the circumference of the disc in the preferred embodiments of the invention, it is preferred to provide holes in the body of the disc so as to provide increased workpiece surface visibility. The holes can have any shape but, for greatest visibility and least disruption of the abrasive surface of the disc, it is preferred that the holes are round in shape. The holes can however be oval or polygonal if desired provide these do not weaken the structure of the disc. The number of these holes is preferably the same as the number of portions removed from the periphery and thus is preferably from 3 to 9 and more preferably 3 to 6. The location of the holes is preferably such as to increase the visibility of the workpiece surface without diminishing the dimensional stability of the disc under conditions of use or the grinding effectiveness to any unacceptable degree. It is preferred therefore that the holes be located between the portions removed from the circumference and at a radial distance from the center of the disc such that the greatest radial distance of each hole from the center is about the same as the shortest radial dimension of the disc as a result of the removal of a portion of the circumference of the disc. It is preferred that the greatest radial dimension of each hole be less that 30% and more preferably less than 20% of the greatest radial dimension of the disc.

The radius of the disc is not an integral part of the invention. However the most practical applications for such discs require radii of from about 8 cm to 25 cm and most preferably from 11 to 18 cm.

The invention is now further described with reference to the attached Drawing, (FIG. 1), which is a profile of a preferred abrasive disc according to the invention.

The disc, 1, has a generally round configuration with three spaced indentations, 2, remaining after removal of portions of the circumference. The indentations have leading edges, 3, and trailing edges, 4, and a point of greatest depth, 6. The leading and trailing edges each meet the circumference in rounded angles, 7 and 8 respectively, and the point of greatest depth is located adjacent the leading edge such that the distance of point 6 from point 7, measured along the original circumference of the disc, is less than 20% of the circumferential distance separating points 7 and 8.

The disc is also provided with round holes, 9, spaced between the locations of the portions removed from the circumference and at a radial distance from the center of the disc that is less than the shortest radial dimension of the disc after removal of the portions from the circumference.

The disc also has an axially located mounting hole, 10, which, as shown, is shaped to correspond to a mounting bush, (not shown).

The discs can be used with a similarly shaped backup pad but even a backup pad with an equal number of spaced chord segments removed can be used if the greatest radial dimension corresponds to, or is slightly smaller than, that of the disc according to the invention with which it is used and the locations of the chords removed correspond those of the portions removed from the circumference of the abrasive disc.

Modifications to the features shown in the FIGURE could clearly be made without departing from the essential spirit of the invention. All these are included in the invention claimed herein.

What is claimed is:

1. An abrasive disc having a generally circular configuration with a design direction of rotation when in use, said disc having from 3 to 9 spaced portions removed from the circumference of the disc each such portion having leading and trailing edges defined with respect to the design direction of rotation of the disc, and a length defined by the circumferential distance between the points at which the leading and trailing edges meet the circumference, wherein the deepest radial penetration of the removed portion of the disc occurs adjacent the leading edge of each removed portion and is sufficient to permit continuous vision through at least the peripheral regions of the disc and wherein the leading and trailing edges of each removed portion meet the circumference in rounded angles.

2. An abrasive disc according to claim 1 in which, for each removed portion, the leading and trailing edges meet the circumference of the disc at points separated by a circumferential distance X wherein X is less than one sixth of the circumference of the disc, and the disc has a shortest radial dimension on a radius that intersects with the circumference at a point that is less than one third of the distance X from the point at which the leading edge meets the circumference.

3. An abrasive disc according to claim 1 in which the number of portions removed from the circumference of the disc is three.

4. An abrasive disc according to claim 1 in which the disc is provided with holes located between the portions removed from the circumference and at a radial distance form the center of the disc that is less than the shortest radial dimension of the disc.

5. An abrasive disc according to claim 4 in which the holes are located so as to provide that, in use, the combined effect of the holes and the removed portions from the circumference is to permit continuous vision through at least half of the radius of the disc.

* * * * *